US006540169B2

(12) United States Patent
Chuang

(10) Patent No.: US 6,540,169 B2
(45) Date of Patent: Apr. 1, 2003

(54) TUBE RECEIVER ASSEMBLED AND DETACHED RAPIDLY

(76) Inventor: Po-Chao Chuang, 1F, No 71 Huai Ning Street, Taichung (TW)

( * ) Notice: Subject to any disclaimer, the term of this patent is extended or adjusted under 35 U.S.C. 154(b) by 0 days.

(21) Appl. No.: 09/905,886

(22) Filed: Jul. 17, 2001

(65) Prior Publication Data

US 2003/0015617 A1 Jan. 23, 2003

(51) Int. Cl.[7] ..... B65H 75/40
(52) U.S. Cl. ..... 242/395; 242/405.3; 137/355.26
(58) Field of Search ..... 242/395, 395.1, 242/405.3, 406, 407, 401; 137/355.16, 355.2, 355.26, 355.27

(56) References Cited

U.S. PATENT DOCUMENTS 1,915,632 A * 6/1933 Marks ..... 242/395
3,186,657 A * 6/1965 Roe ..... 242/395.1
3,532,289 A * 10/1970 Sutz ..... 242/405.3
4,061,290 A * 12/1977 Harrill ..... 242/395.1
4,251,038 A * 2/1981 Gename ..... 242/405.3
4,306,688 A * 12/1981 Hechler ..... 242/405.3
4,429,839 A * 2/1984 Jessamine ..... 242/405.3
5,014,925 A * 5/1991 Cump ..... 242/405.3

* cited by examiner

*Primary Examiner*—John M. Jillions
(74) *Attorney, Agent, or Firm*—Rosenberg, Klein & Lee

(57) ABSTRACT

A tube receiver has a winding disk and a body. The winding disk is extended with a shaft which is capable of being engaged to the body. Therefore, the winding disk pivotally rotates along the body. The shaft has an annular buckling groove at an end passing through the body. A slidable buckle installed at the body is configured with respect to the buckling groove of the shaft. The buckle has a flange. The flange is engaged to the buckling groove of the shaft for confining the axial position of the shaft. As the flange of the buckle separates from the buckling groove of the shaft, the winding disk will separate from the body.

2 Claims, 5 Drawing Sheets

TUBE RECEIVER ASSEMBLED AND DETACHED RAPIDLY

FIELD OF THE INVENTION

The present invention relates to a tube receiver, and particularly to a tube receiver which can be assembled and detached from the body rapidly.

DESCRIPTION OF RELATED ART

With reference to FIG. 5, a tube receiver in accordance with the present invention comprises a frame (81) and an H-shaped winding wheel (82) with a winding portion 83 pivotally mounted to the frame (81) for winding a water tube. A receiving groove (84) is defined in the winding portion (83) for receiving a joint (not shown of the water tube. A handle (85) is pivotally mounted to the frame (81) and centrally connected to the winding wheel (82) for rotating the winding wheel (82). A pair of rollers (86) is connected to the frame (81). A gap (not numbered) is formed between the two rollers (86) and the water tube passes through the gap such that the water tube is compressed to have a flat shape for reducing its volume when winding the water tube.

In the aforesaid tube receiver, the water tube must be pulled out completely from the winding portion (83) before using the water tube. However, since the water tube is wound around the receiving portion (83), and water flows through the rollers (86) in the water tube, a larger force is needed for pulling the water tube and thus, time is consumed.

SUMMARY OF THE INVENTION

The main objective of the present invention is to provide an improved tube receiver assembled and detached rapidly. To achieve the objective, the tube receiver assembled and detached rapidly in accordance with the present invention comprises a hollow body and a winding disk partially and pivotally received in the hollow body. A hollow shaft centrally extends from the winding disk and separately received in the hollow body. The hollow shaft is adapted to wind the tube into the hollow body. The hollow shaft extends through the hollow body and a buckle detachably mounted on a free end of the hollow shaft to hold the winding disk in place. Consequently, the winding disk of the tube receiver in accordance with the present invention ca be assembled and detached from the hollow body rapidly.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, feature, and characteristics of the present invention, but not to be used to confine the scope and spirit of the present invention defined in the appended claims.

Figure 1:
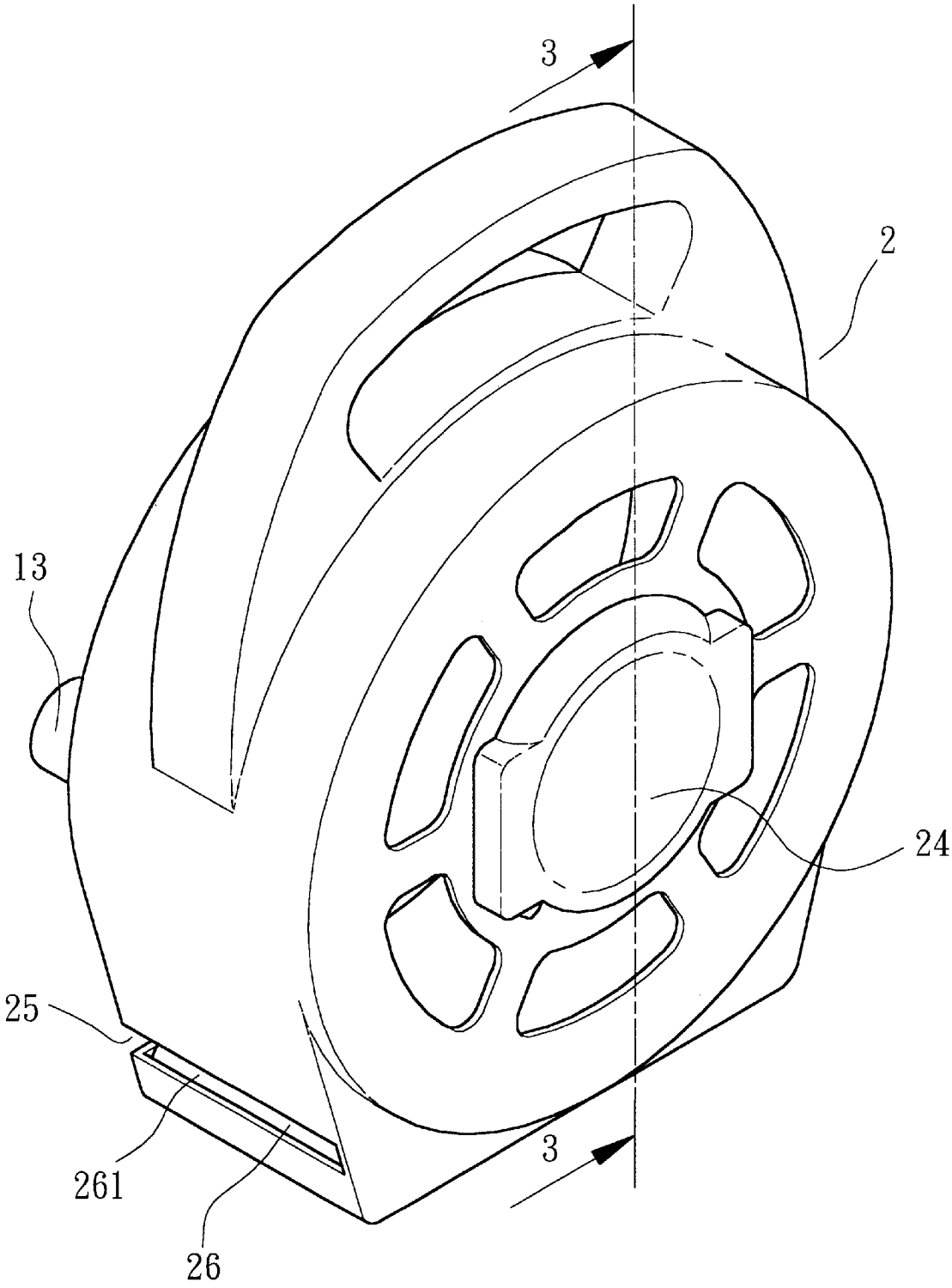
FIG. 1 is a perspective view of the present invention.
Figure 2:
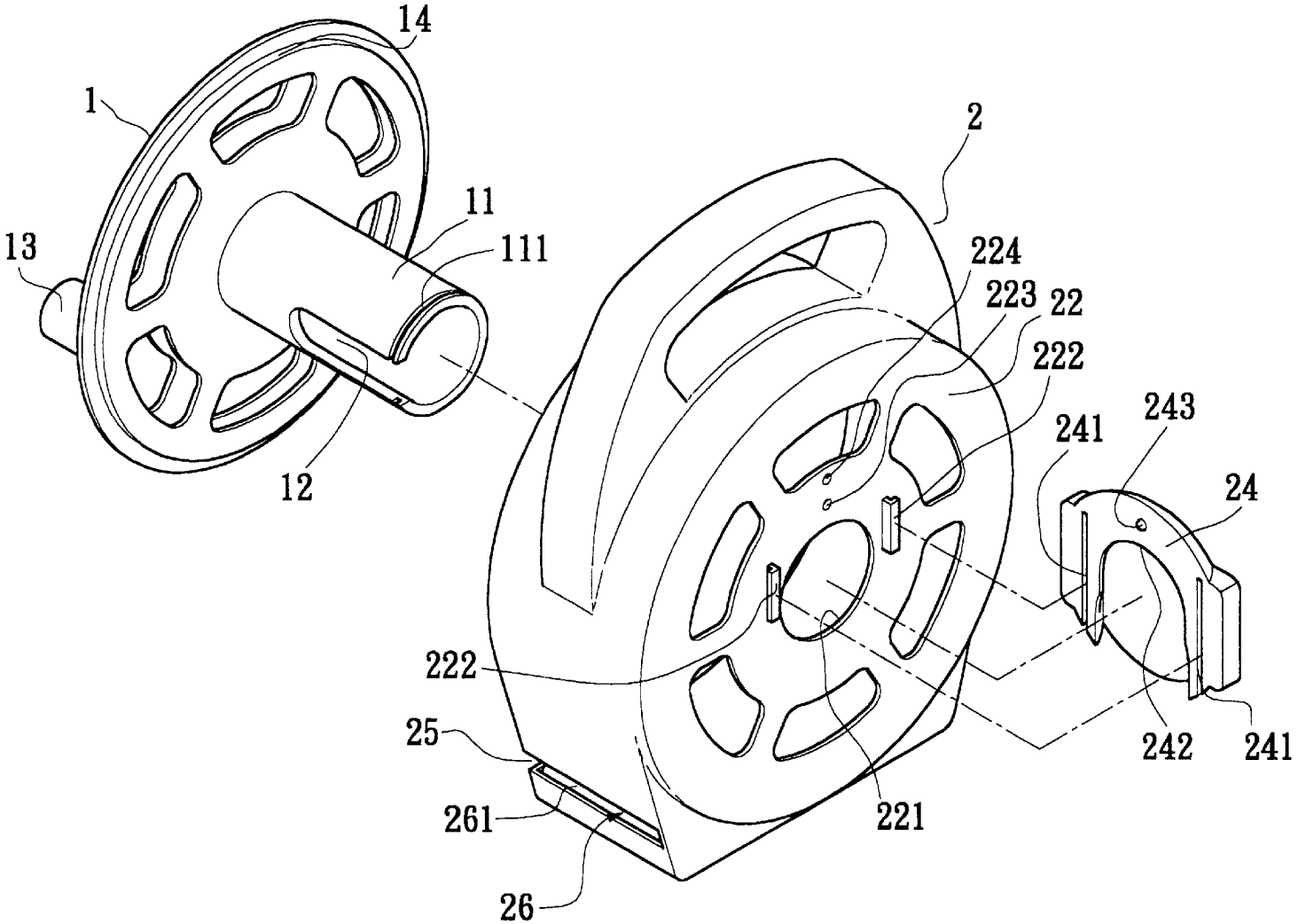
FIG. 2 is an exploded perspective view of the present invention.
Figure 3:
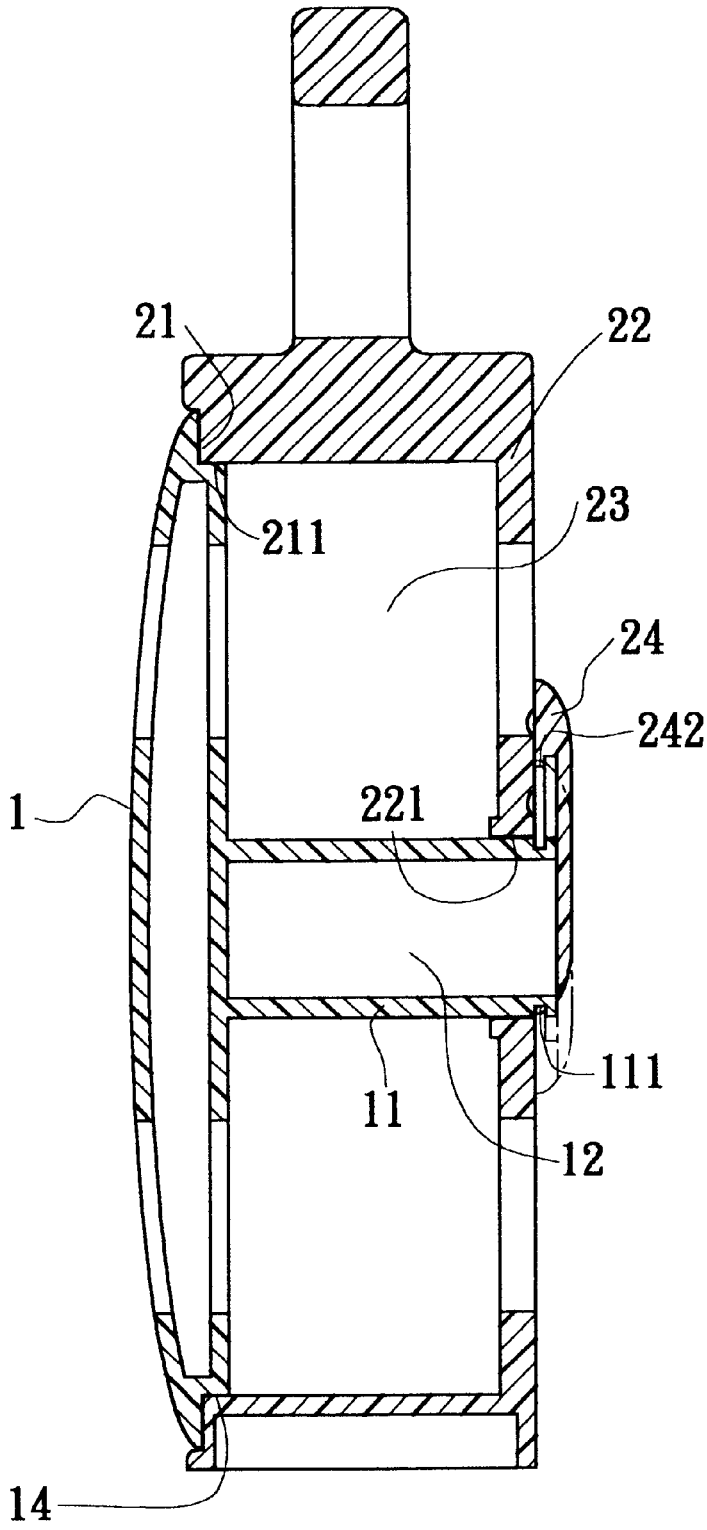
FIG. 3 is a cross sectional view along the line 3—3 in FIG. 1.
Figure 4:
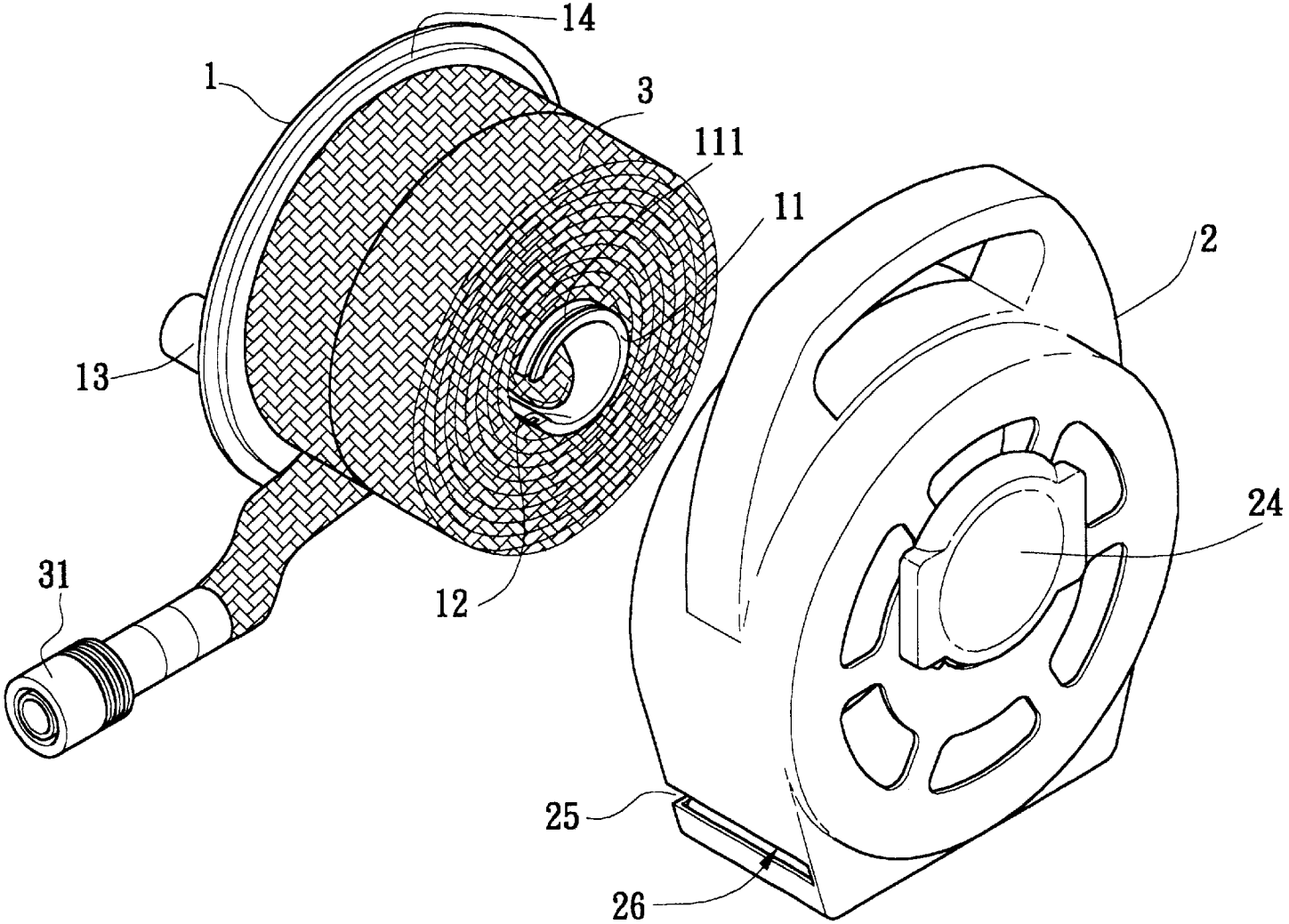
FIG. 4 is an operational exploded schematic view of the present invention.
Figure 5:
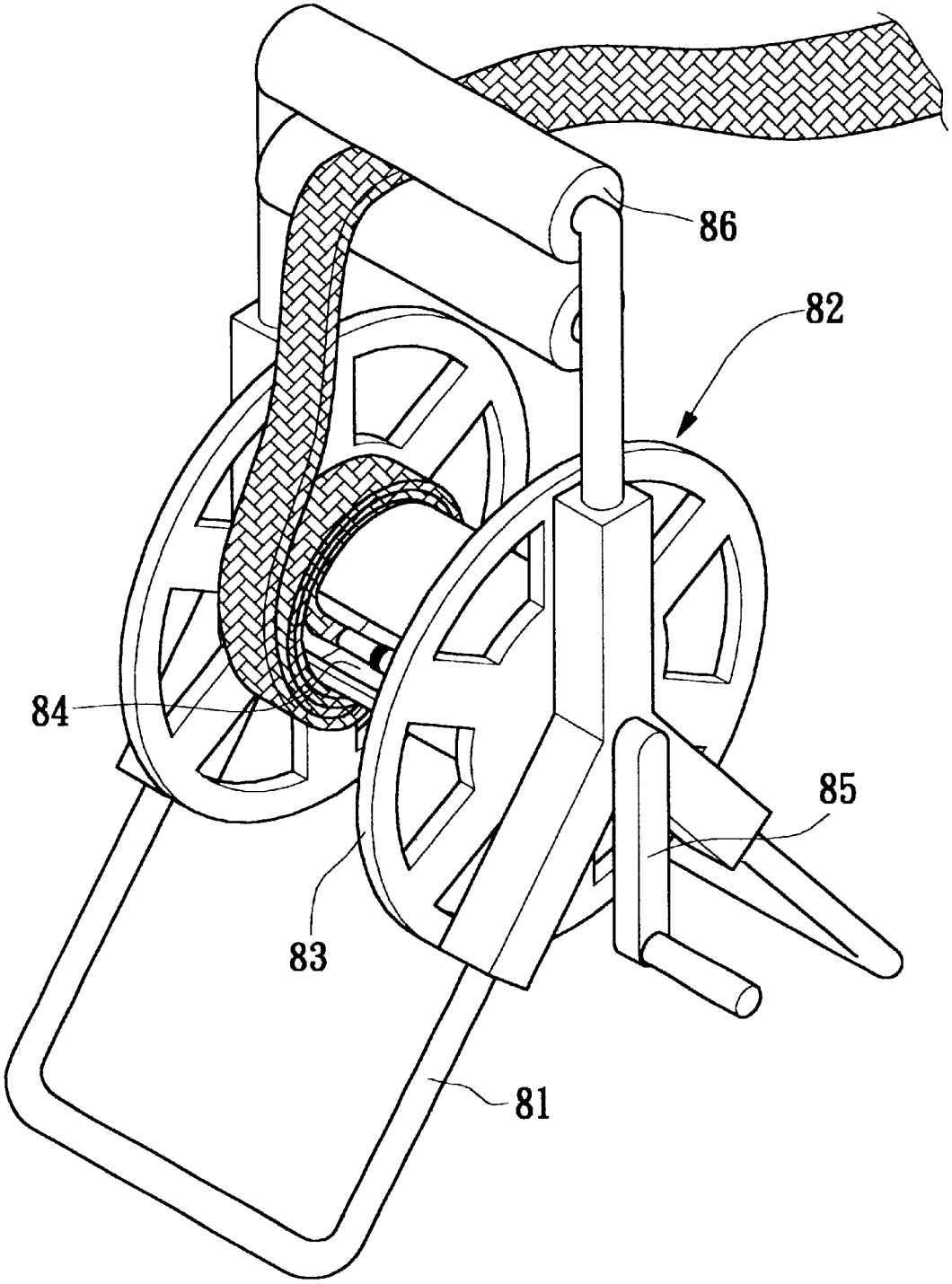
PRIOR ART FIG. 5
FIG. 5 shows a prior tube receiver.

With reference to FIGS. 1–4, a tube receiver in accordance with the present invention comprises a cylindrical body (2) with an open end (21) and a close end (22), a winding disk (1) pivotally mounted to the cylindrical body (2) for closing the open end (21) of the cylindrical body (2) and is adapted to wind the tube.

The winding disk (1) comprises a hollow shaft (11) centrally extending from a first side of the winding disk (1) and centrally extending through the close end (22) of the cylindrical body (2). The hollow shaft (11) has a receiving groove (12) defined in an outer periphery of the shaft (11) and communicating with an inner periphery of the shaft (11) such that one end of the tube passes through the receiving groove (12) and received in the hollow shaft (11). A trolley crank (13) is perpendicularly and pivotally attached to a second side of the winding disk (1). A pivot portion (14) extends from the first side of the winding disk (1) and pivotally received in the cylindrical body (2), and an annular buckling groove (111) defined in the hollow shaft (11) near a free end of the hollow shaft (11).

The cylindrical body (2) comprises a receiving space 23 defined in the cylindrical body (2) and adapted to receive the tube in the cylindrical body (2). The cylindrical body (2) includes a shoulder (211) formed on the open end of the cylindrical body (2) and a through hole (221) centrically defined in the close end of the cylindrical body (2). The cylindrical body (2) has two tracks (222) extending form the close end thereof and parallel to each other, and a buckle (24) travels along the two tracks (222) and pivotally engaged to the hollow shaft (11) to hold the winding disk (1) in place. The buckle (24) includes sliding trenches (241) defined to slidably receive the two tracks (222) of the cylindrical body (2). A flange (242) extends from the buckle (24) and is selectively received in the buckling groove (111 ) to prevent the winding disk (1) from detaching from the cylindrical body (2). The buckle (24) has a boss (243) extending from the buckle (24) toward the close end of the cylindrical body (2). The cylindrical body (2) includes a first concavity (223) and a second concavity (224) defined in the close end of the cylindrical body (2) for receiving the boss (243). A distance between the first concavity (223) and a periphery of the through hole (221) is shorter than that between the second concavity (224) and the periphery of the through hole (221) such that the flange (242) is received in the buckling groove (111) to hold the winding disk (1) in place when the boss (243) received in the first concavity (223), and the flange (242) is separated from the buckling groove (111) and the winding disk (1) can be detached from the cylindrical body (2) when the boss (243) is received in the second concavity (224).

The cylindrical body (2) includes a slot (26) defined in an outer periphery of the cylindrical body (2). The slot (26) communicates with the inner periphery of the cylindrical body (2) and extends to the open end of the cylindrical body (2) for defining an opening (25) to allow the tube passed into the slot (26). A pair of roller (261) is mounted in the cylindrical body (2) near the slot (26) and a gap (not numbered) is formed between the two rollers (261) and corresponds to the slot (26). The pair of roller (261) is provided to compress the tube after passing through the opening (25) and during winding.

In operating, when rewinding the water tube (3), the buckle (24) on the cylindrical body (2) is upwardly pushed so that the flange (242) is separated from the buckling groove (111), the boss (243) is received in the second concavity (224) and the winding disk (1) is detached from the cylindrical body (2). One end of the water tube (3) is placed into the receiving groove (12) in the hollow shaft (11). The water tube (3) passes through the opening (25) and is compressed between the two rollers (261) after being placed in the receiving groove (12). Then the winding disk (1) is assembled with the cylindrical body (2) and the buckle (24) is downwardly pushed to make the flange (242) engaged into the buckling groove (111) and the boss (243) is received in the first concavity (223) to hold the winding disk (1) in place. Consequently, the trolley (13) can be operated for rotating the winding disk (1) so that the water tube (3) is wound around the hollow shaft (11) for receiving the water tube (3) in the cylindrical body (2). As it is desired to take the water tube (3) out for using. It is only necessary to upwardly push the buckle (24) so that the flange (242) is separated from the buckling groove (111). Consequently, the winding disk (1) can be detached from the cylindrical body (2) and the water tube (3) can be pulled out rapidly. Thus, the user may use the water tube (3) in a short time.

The buckle (24) further comprises a restoring structure so that the flange (242) of the buckle (24) sustains to be engaged to the buckling groove (111) of the shaft (11). The restoring structure has a configuration known by those skilled in the art, for example, a spring. The buckle (24) is confined by the spring so that the flange (242) sustains to be engaged to the buckling groove (111) of the shaft (11).

The present invention are thus described, it will be obvious that the same may bee varied in many ways. Such variations are not to be regarded as a departure from the spirit and scope of the present invention, and all such modifications as would be obvious to one skilled in the art are intended to be included within the scope of the following claims.

What is claimed is:

1. A tube receiver comprises:

a winding disk including a hollow shaft centrally extending from a first side of the winding disk, the hollow shaft having a receiving groove defined in an outer periphery of the hollow shaft and communicating with an inner periphery of the hollow shaft, the receiving groove being adapted to allow one end of the tube to extend through the hollow shaft and be received in the hollow shaft, a trolley crank perpendicularly and pivotally attached to a second side of the winding disk for a user to rotate the winding disk and wind the tube, the hollow shaft having a buckling groove defined in a free end thereof;

a cylindrical body including a receiving space formed therein to partially pivotally receive the winding disk and adapted to receive the wound tube, the cylindrical body including an open end for pivotally receiving the winding disk and a closed end, the cylindrical body having a slot formed in an outer periphery thereof communicating with an inner periphery of the cylindrical body and extending to the open end of the cylindrical body to allow the tube to be passed into the cylindrical body, the free end of the hollow shaft extending through the closed end of the hollow body; and, a buckle slidably attached to the free end of the hollow shaft to hold the winding disk in place, the buckle having a flange extending from the buckle and selectively received in the buckling groove to hold the winding disk in place, wherein the winding disk can be detached from the cylindrical body when the flange of the buckle is separated from the buckling groove in the free end of the hollow shaft.

2. The tube receiver as claimed in claim 1, wherein the cylindrical body comprises a pair of rollers mounted in the cylindrical body adjacent the slot in the cylindrical body, the pair of rollers being adapted for compressing the tube, thereby forcing water in the tube to be drained out of the tube.

* * * * *